US011626676B2

(12) United States Patent
Kobayashi

(10) Patent No.: US 11,626,676 B2
(45) Date of Patent: Apr. 11, 2023

(54) CONNECTOR AND METHOD FOR MANUFACTURING SAME

(71) Applicant: HIROSE ELECTRIC CO., LTD., Kanagawa (JP)

(72) Inventor: Yuki Kobayashi, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 43 days.

(21) Appl. No.: 17/395,076

(22) Filed: Aug. 5, 2021

(65) Prior Publication Data

US 2022/0069493 A1 Mar. 3, 2022

(30) Foreign Application Priority Data

Aug. 25, 2020 (JP) ..... JP2020-141460

(51) Int. Cl.

| | |
|---|---|
| ***H01R 12/91*** | (2011.01) |
| ***H01R 12/71*** | (2011.01) |
| ***H01R 43/24*** | (2006.01) |
| ***H01R 12/70*** | (2011.01) |
| ***H01R 43/16*** | (2006.01) |
| ***H01R 13/629*** | (2006.01) |

(52) U.S. Cl.

CPC ..... *H01R 12/716* (2013.01); *H01R 12/7005* (2013.01); *H01R 12/91* (2013.01); *H01R 13/629* (2013.01); *H01R 43/16* (2013.01); *H01R 43/24* (2013.01)

(58) Field of Classification Search

CPC .. H01R 12/716; H01R 12/7005; H01R 12/91; H01R 13/629; H01R 43/16; H01R 43/24; H01R 13/405; H01R 13/502; H01R 43/18; H01R 13/2407

See application file for complete search history.

(56) References Cited

U.S. PATENT DOCUMENTS

| | | | | |
|---|---|---|---|---|
| 2019/0013610 | A1* | 1/2019 | Suzuki | H01R 13/10 |
| 2019/0348782 | A1* | 11/2019 | Horii | H01R 12/727 |
| 2019/0363491 | A1* | 11/2019 | Suzuki | H01R 13/187 |
| 2021/0376510 | A1* | 12/2021 | Obata | H01R 12/91 |
| 2022/0069493 | A1* | 3/2022 | Kobayashi | H01R 13/629 |
| 2022/0190504 | A1* | 6/2022 | Sakai | H01R 12/716 |

FOREIGN PATENT DOCUMENTS

JP 2019-6/1/9 A 4/2019

* cited by examiner

*Primary Examiner* — Abdullah A Riyami
*Assistant Examiner* — Nelson R. Burgos-Guntin
(74) *Attorney, Agent, or Firm* — Rankin, Hill & Clark LLP

(57) ABSTRACT

Provided is a connector which includes: a fixed housing; a movable housing in the fixed housing which mates with a counterpart connector; and a plurality of terminals held by the fixed housing and the movable housing, the plurality of terminals being configured to contact terminals of the counterpart connector, in which each of the plurality of terminals includes: a first fixed portion buried by integral molding in the fixed housing; a second fixed portion buried by the integral molding in the movable housing; an elastic portion between the first fixed portion and the second fixed portion, the elastic portion having elasticity that allows the movable housing to be displaced relative to the fixed housing; and a contact portion at an end of the second fixed portion, the contact portion having elasticity and being configured to contact the terminal of the counterpart connector mated with the movable housing.

8 Claims, 11 Drawing Sheets

CONNECTOR AND METHOD FOR MANUFACTURING SAME

CROSS-REFERENCE TO RELATED APPLICATION

This application claims priority from Japanese Patent Application No. 2020-141460 filed with the Japan Patent Office on Aug. 25, 2020, the entire content of which is hereby incorporated by reference.

BACKGROUND

1. Technical Field

The present disclosure relates to a connector and a method for manufacturing the same, and particularly relates to a floating connector including a movable housing that can be displaced relative to a fixed housing.

2. Related Art

In a connector for a circuit board, displacement (an error) of a circuit board or casing may occur during assembly or mounting of an electronic device. A connector that allows a counterpart connector to be connected to the connector to move relative to the connector, what is called a floating connector, is known as a connector for a circuit board that can absorb such an error. The floating connector includes a fixed housing and a movable housing. The fixed housing holds one end of a terminal of the connector, and is fixed to a circuit board by soldering the terminal to the circuit board. The movable housing is separate from the fixed housing, is movable relative to the fixed housing, and holds the other end of the terminal of the connector to come into contact with and be connected with the counterpart connector. The terminal of the connector includes an elastic portion that is not supported at all between the portions held by the fixed housing and the movable housing. The elastic portion deforms elastically; accordingly, the movable housing becomes movable relative to the fixed housing, which enables what is called floating.

Examples of the technology related to such a floating connector include a technology described in JP-A-2019-067779.

SUMMARY

A connector according to the present embodiment is configured to include: a fixed housing; a movable housing in the fixed housing, the movable housing being configured to be displaceable relative to the fixed housing and mate with a counterpart connector; and a plurality of terminals held by the fixed housing and the movable housing, the plurality of terminals being configured to contact terminals of the counterpart connector, in which each of the plurality of terminals includes: a first fixed portion buried by integral molding in the fixed housing; a second fixed portion buried by the integral molding in the movable housing; an elastic portion between the first fixed portion and the second fixed portion, the elastic portion having elasticity that allows the movable housing to be displaced relative to the fixed housing; and a contact portion at an end of the second fixed portion, the contact portion having elasticity and being configured to contact the terminal of the counterpart connector mated with the movable housing.

DETAILED DESCRIPTION

Figure 1:
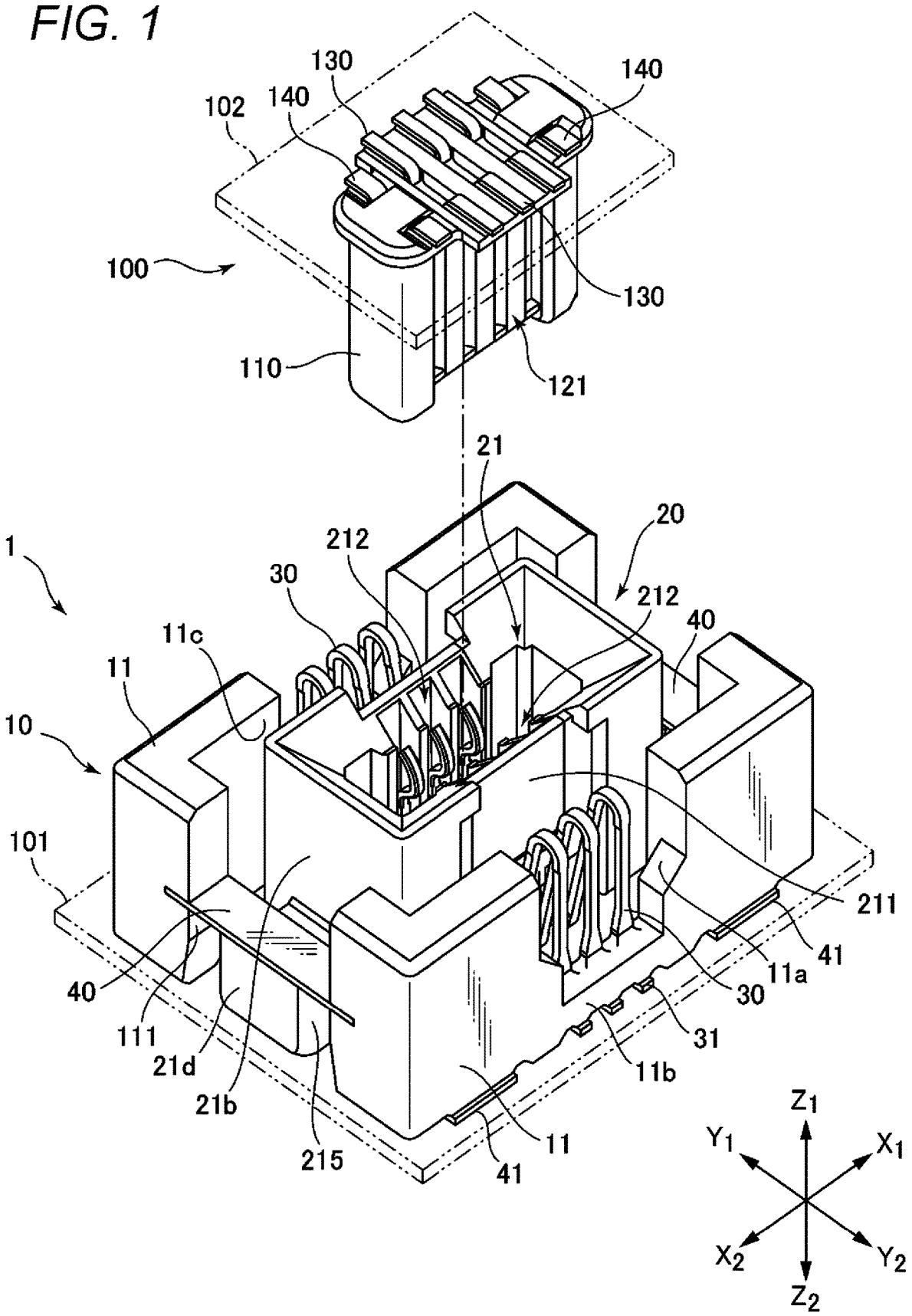
FIG. 1 is a perspective view of a connector and a counterpart connector according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Generally, a floating connector is configured in such a manner that a fixed housing and a movable housing are produced separately and assembled by a method such as press fit of a terminal into the fixed housing and press fit of the movable housing into the fixed housing where the terminal of the movable housing has been press-fitted. Hence, if the direction of the press fit of the movable housing into the fixed housing is, for example, a height direction of the connector, the size of the connector in the height direction may vary depending on the press fit condition. As a result, the size of the product may vary. Hence, the product needs to be designed with a sufficient space allowance in the height direction of the connector. Accordingly, there is a problem increasing the size of the product.

Moreover, if the assembly method by press fit is employed, a connector configured by this method is configured by connecting a fixed housing and a movable housing with a terminal. At least two steps of connecting the fixed housing and the terminal and of connecting the movable housing and the terminal are required to connect the fixed housing and the movable housing with the terminal. Hence, there is a problem that the number of manufacturing man-hours for assembly is increased and the productivity of the product is reduced.

The present disclosure has been made to solve a problem such as described above, and an object thereof is to provide a connector that can promote a reduction in size and an increase in productivity, and a method for manufacturing the same.

A connector according to the present disclosure includes: a fixed housing; a movable housing in the fixed housing, the movable housing being configured to be displaceable relative to the fixed housing and mate with a counterpart connector; and a plurality of terminals held by the fixed housing and the movable housing, the plurality of terminals being configured to contact terminals of the counterpart connector, in which each of the plurality of terminals includes: a first fixed portion buried by integral molding in the fixed housing; a second fixed portion buried by the integral molding in the movable housing; an elastic portion between the first fixed portion and the second fixed portion, the elastic portion having elasticity that allows the movable housing to be displaced relative to the fixed housing; and a contact portion at an end of the second fixed portion, the contact portion having elasticity and being configured to contact the terminal of the counterpart connector mated with the movable housing.

A method for manufacturing the connector according to the present disclosure includes a molding step of molding the fixed housing and the movable housing, in which the molding step includes: bringing at least a part of the second fixed portion of the terminal of the connector inserted into a mold into contact with the mold and holding the terminal of the connector in the mold, and injecting resin into the mold.

According to the present disclosure, it is possible to obtain a connector that can promote a reduction in size and an increase in productivity, and a method for manufacturing the same.

FIG. 1 is a perspective view of a connector and a counterpart connector according to the embodiment. For convenience of explanation, let the longitudinal direction (terminal arrangement direction) of a connector 1 be an X (X1X2) direction, let the transverse direction (terminal opposing direction) be a Y (Y1Y2) direction, and let the height direction (mating and unmating direction) be a Z (Z1Z2) direction, in the following embodiment. Each direction is for explaining the relative positional relationships of parts configuring the connector, and does not indicate an absolute direction. In the height direction, the Z1 side may be relatively referred to as "upward", "upper side", or "up", and the Z2 side may be relatively referred to as "downward", "lower side", or "down".

As illustrated in FIG. 1, the connector 1 is a receptacle connector that is mounted on a circuit board 101. The connector 1 includes a fixed housing 10 that is fixed to the circuit board 101, a movable housing 20 that is placed inside the fixed housing 10, can be displaced relative to the fixed housing 10, and mates with a counterpart connector 100, a plurality of terminals 30 that is held by the fixed housing 10 and the movable housing 20, and comes into contact with terminals 130 of the counterpart connector 100, and a pair of reinforcing fittings 40 that is held by the fixed housing 10. The connector 1 of the embodiment is what is called a floating connector that can absorb displacement (an error) of the fixed housing 10 relative to the circuit board 101, or displacement (an error) of the connector 1 relative to a casing to be stored, in the X, Y, and Z directions even if the displacement occurs. In other words, the plurality of terminals 30 deforms elastically, and the movable housing 20 is displaced in the X, Y, and Z directions. Accordingly, even if the connectors are displaced relative to each other, the connectors can be properly mated within a certain permissible range. The pair of reinforcing fittings 40 is configured in such a manner as to regulate the displacement of the movable housing 20 in the Z direction.

The counterpart connector 100 is a plug connector that is mounted on a circuit board 102. The counterpart connector 100 includes a housing 110, a plurality of the terminals 130, and a pair of reinforcing fittings 140 that is held by the housing 110. The connector 1 and the counterpart connector 100 mate with each other. Accordingly, the plurality of terminals 30 of the connector 1 comes into contact with the plurality of the corresponding terminals 130 of the counterpart connector 100, respectively, to be electrically connected.

In the embodiment, the connector 1 and the counterpart connector 100 are configured in such a manner as to be symmetric in both X and Y directions. The plurality of terminals 30 of the connector 1 and the plurality of the terminals 130 of the counterpart connector 100 are arranged in groups of three. It is configured in such a manner that the arranged terminals 30 face each other and the arranged terminals 130 face each other. A total of six terminals 30 and a total of six terminals 130 are provided. However, the number of the terminals 30 and 130 is not limited to six. Moreover, the fixed housing 10, the movable housing 20, and the housing 110 are formed of, for example, insulating material such as resin, plastic material, or carbon fibers. The fixed housing 10 and the movable housing 20 are integrally molded (insert molded) and formed with the plurality of terminals 30 as inserts. In other words, the fixed housing 10 and the movable housing 20 are connected by the plurality of terminals 30. The plurality of terminals 30 of the connector 1 and the plurality of the terminals 130 of the counterpart connector 100 are formed of conductive material such as metal. The reinforcing fittings 40 of the connector 1 and the reinforcing fittings 140 of the counterpart connector 100 are formed of material that can undergo bending, such as metal. However, the components of the connector 1 and the counterpart connector 100, and materials thereof are not necessarily limited to those described above. The reinforcing fittings 40 may be formed as, for example, part of the fixed housing 10.

Figure 2:
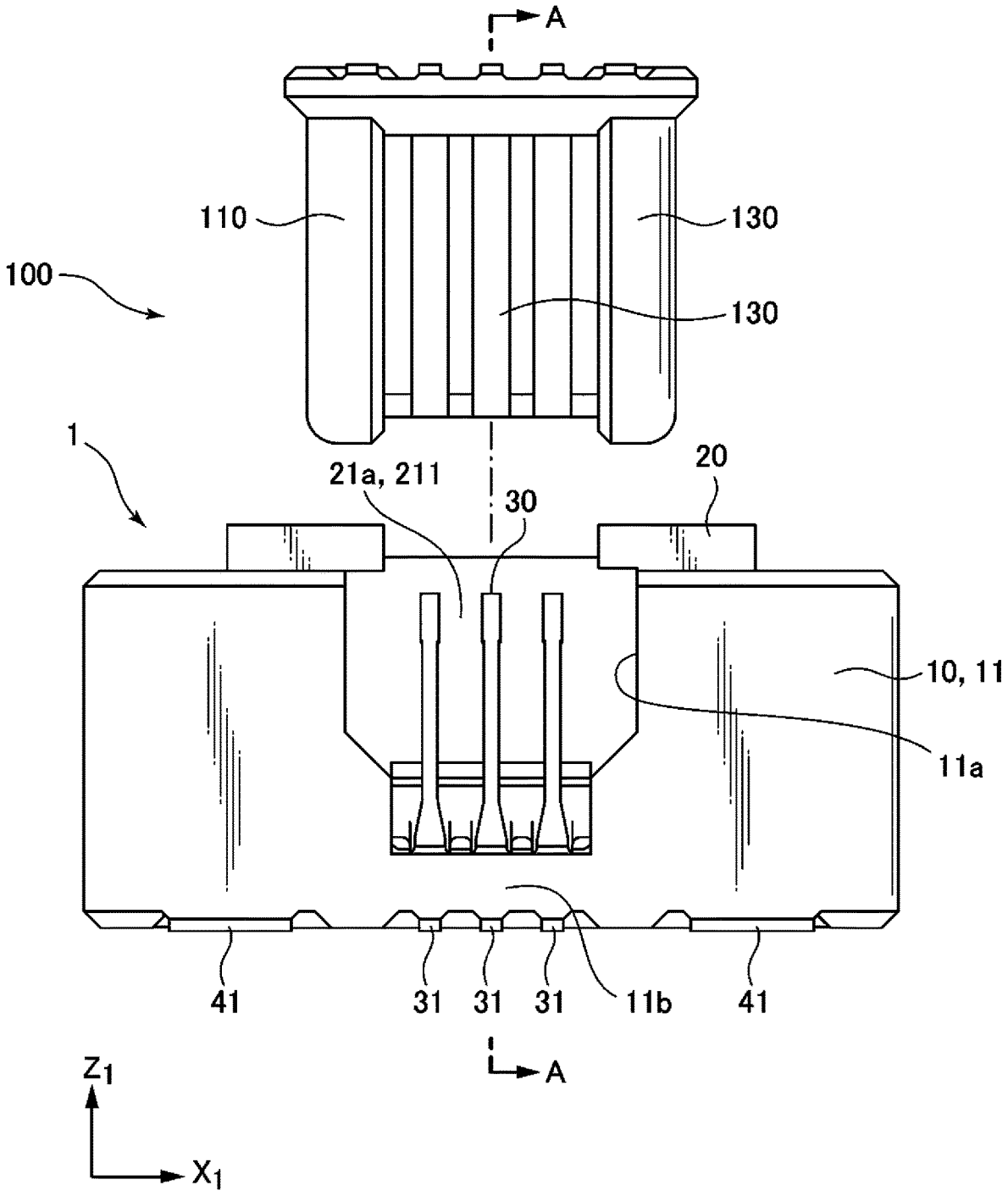
FIG. 2 is a front view of the connector and the counterpart connector according to the embodiment of the present disclosure.
Figure 3:
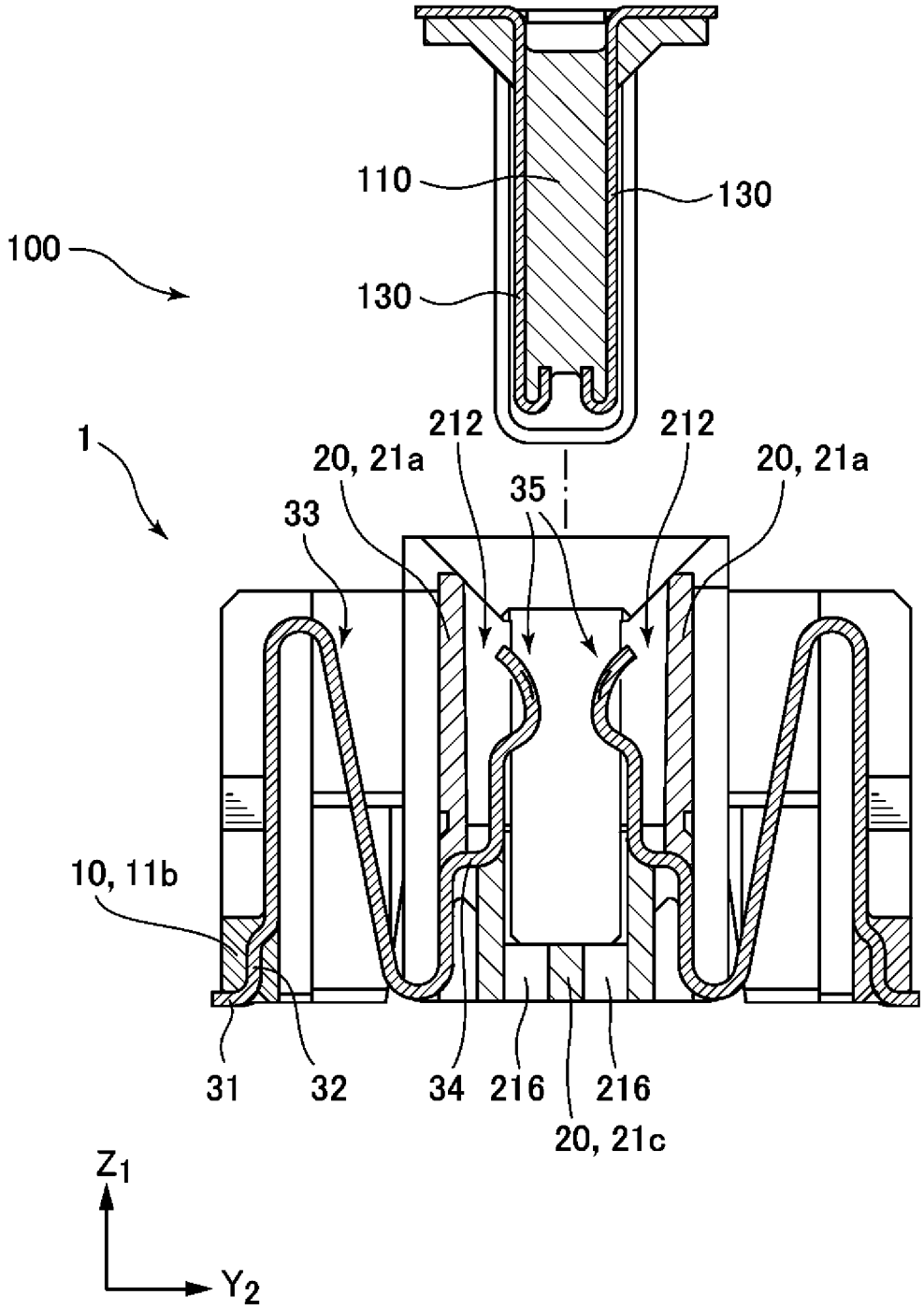
FIG. 3 is a cross-sectional view of section A-A illustrated in FIG. 2.
Figure 4:
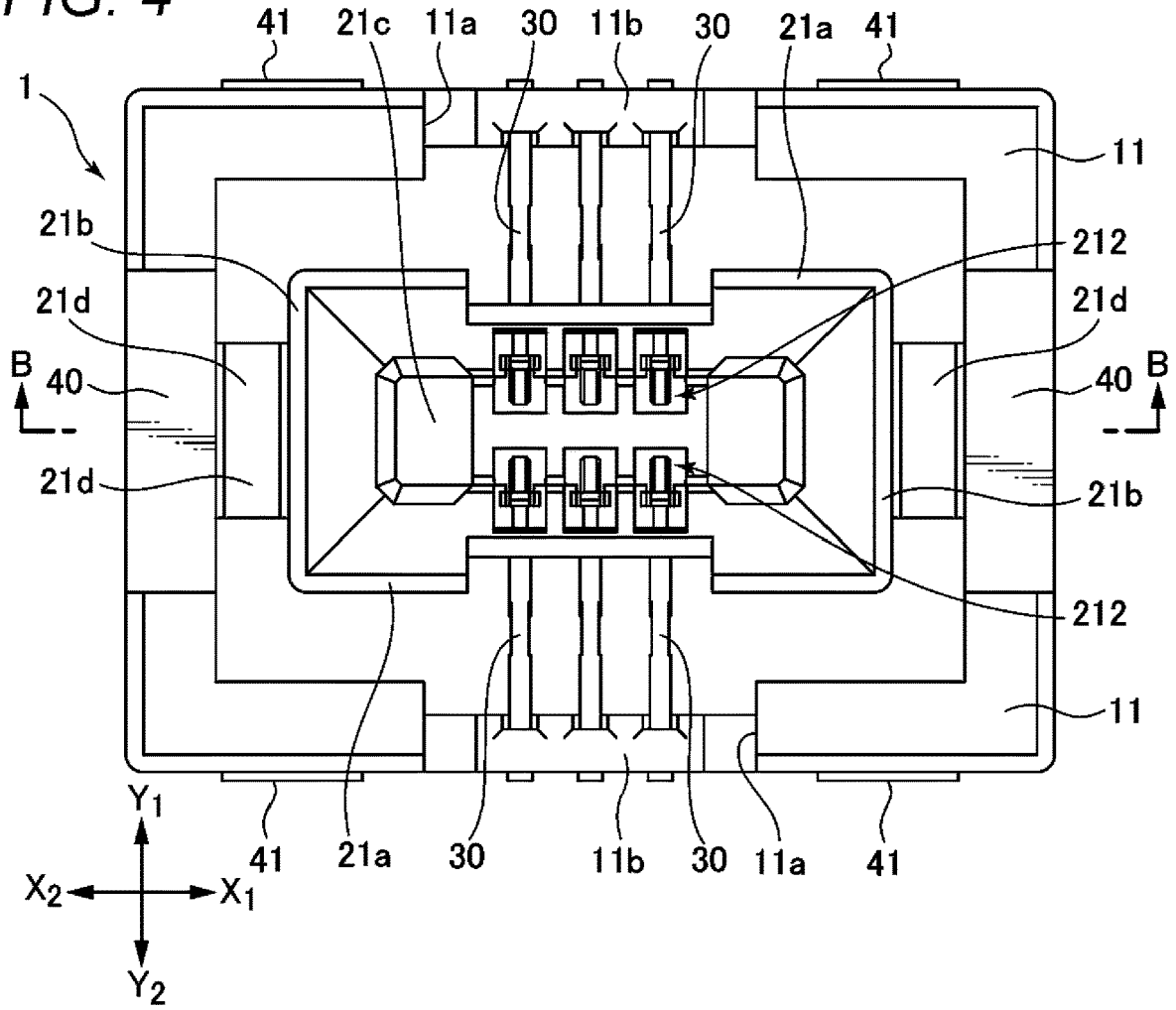
FIG. 4 is a plan view of the connector according to the embodiment of the present disclosure.
Figure 5:
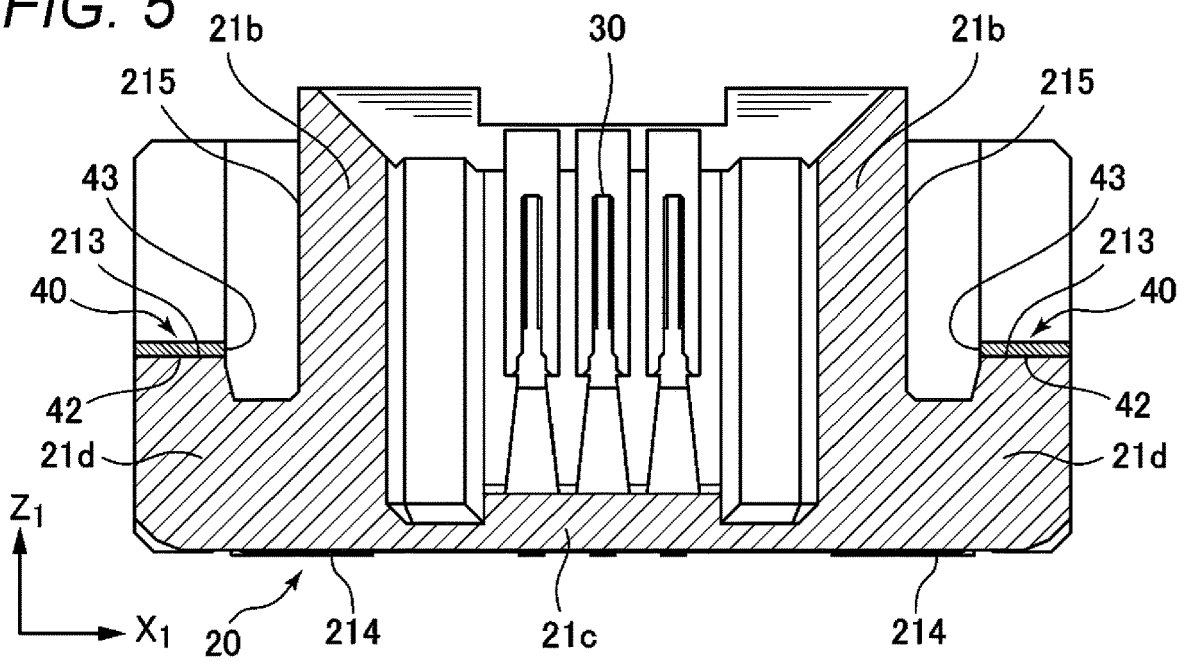
FIG. 5 is a cross-sectional view of section B-B illustrated in FIG. 4.

FIG. 2 is a front view of the connector 1 and the counterpart connector 100 according to the embodiment. FIG. 3 is a cross-sectional view of section A-A illustrated in FIG. 2. FIG. 4 is a plan view of the connector 1 according to the embodiment. FIG. 5 is a cross-sectional view of section B-B illustrated in FIG. 4.

As illustrated in FIGS. 1 to 5, the fixed housing 10 includes a pair of side wall portions 11 facing each other in the Y direction. The pair of side wall portions 11 is provided, extending in the X direction. Both ends of the side wall portions 11 are connected by the pair of reinforcing fittings 40. In the embodiment, the side wall portions 11 have a U shape along the Z direction in plan view. Both legs of the U shape of one of the side wall portions 11 are placed, spaced apart from and facing both legs of the U shape of the other side wall portion 11. Accordingly, the fixed housing 10 is formed. The pair of reinforcing fittings 40 connects both legs of the U shape of one of the side wall portions 11 to both legs of the U shape of the other side wall portion 11. Accordingly, the fixed housing 10 surrounds the movable housing 20. The reinforcing fitting 40 is formed by folding over a long plate that is long in the Y direction in such a manner as to form a protrusion as viewed from the side in the X direction. As illustrated in FIG. 1, a center portion of the reinforcing fitting 40 is exposed between the side wall portions 11. Board connection portions 41, which are both ends of the reinforcing fitting 40, are exposed from a bottom portion of the fixed housing 10 (the side wall portions 11).

A center portion of the side wall portion 11 in the X direction is provided with a notch portion 11*a* and a holding portion 11*b*. The notch portion 11*a* is a space where the terminals 30 are placed. The holding portion 11*b* holds a part (here, a first fixed portion 32 described below) of the terminal 30.

A board connection portion 31, which is described below, of the terminal 30 and the board connection portions 41 of the reinforcing fitting 40 are exposed from the bottom portion of the fixed housing 10. The board connection portion 31 of the terminal 30 and the board connection portions 41 of the reinforcing fitting 40 are soldered to the circuit board 101. Accordingly, the fixed housing 10 is fixed to the circuit board 101.

As illustrated in FIGS. 1 to 5, the movable housing 20 includes a mating recessed portion 21 protruding upward from the fixed housing 10. When the connectors are mated, the counterpart connector 100, or more specifically, a mating protruding portion 121, mates with the mating recessed portion 21. Specifically, the mating recessed portion 21 includes a pair of side wall portions 21*a* facing each other in the Y direction, a pair of connecting wall portions 21*b* that connects both ends of the pair of side wall portions 21*a*, a bottom portion 21*c* that connects the pair of side wall portions 21*a* and the pair of connecting wall portions 21*b*, and a pair of regulation portions 21*d* that extends in the X direction from the pair of connecting wall portions 21*b*.

The pair of side wall portions 21*a* is provided, extending in the X direction. The pair of connecting wall portions 21*b* is provided, extending in the Y direction. The bottom portion 21*c* is provided, stretching in the X and Y directions on bottom portions of the side wall portions 21*a* and the connecting wall portions 21*b*. A space defined by the pair of side wall portions 21*a*, the pair of connecting wall portions 21*b*, and the bottom portion 21*c* is a space inside the mating recessed portion 21 into which the mating protruding portion 121 is inserted. Each of the pair of side wall portions 21*a* is provided with a recessed portion 211 and storage portions 212. The recessed portion 211 is provided, recessed inward, in an outer surface of the side wall portion 21*a* on a side facing the fixed housing 10. The storage portions 212 are provided in an inner surface of the side wall portion 21*a* on a side facing the other side wall portion 21*a*, and each store a distal end side, which is a free end, of the terminal 30. The recessed portion 211 forms a space provided to allow the terminal 30, or more specifically, an elastic portion 33 described below, to be displaced to prevent physical interference of the terminal 30 with the side wall portion 21*a* when the terminal 30 deforms elastically. The storage portion 212 is a portion that stores the terminal 30. The storage portion 212 is provided, recessed outward, in the inner surface of the side wall portion 21*a* for the corresponding terminal 30. The space inside the storage portion 212 communicates with the space inside the mating recessed portion 21. The bottom portion 21*c* is provided with holes 216 penetrating in the Z direction. The hole 216 is provided at a position below a curved portion 35*b* described below, and causes the internal space of the mating recessed portion 21 to communicate with the outside of the movable housing 20. The movable housing 20 holds parts (here, second fixed portions 34 described below) of the plurality of terminals 30. In the embodiment, the side wall portion 21*a* (a bottom portion of the storage portion 212) holds the second fixed portion 34 of the terminal 30.

The pair of regulation portions 21*d* regulates the range of movement of the movable housing 20 relative to the fixed housing 10. Specifically, as illustrated in FIG. 1, the regulation portion 21*d* extends in the X direction from the connecting wall portion 21*b*. A part of the regulation portion 21*d* is located between the pair of side wall portions 11 and below the reinforcing fitting 40, and extends upward. Hence, as illustrated in FIGS. 1 to 5, an upper surface 213 of the regulation portion 21*d* contacts a lower surface 42 of the reinforcing fitting 40 to regulate the movement in the Z1 direction. A lower surface 214 of the regulation portion 21*d* and a mounting surface being a surface of the circuit board 101 contact each other to regulate the movement in the Z2 direction.

Moreover, as illustrated in FIG. 5, a side surface 215 of the connecting wall portion 21*b* contacts a side surface 43 of the reinforcing fitting 40 to regulate the movement in the X direction. As illustrated in FIG. 1, a side surface 215 of the regulation portion 21*d* contacts an end surface 111 of the side wall portion 11 to regulate the movement in the Y direction. The side surface 215 of the regulation portion 21*d* stretches in the X and Z directions. Two side surfaces 215 are provided to one regulation portion 21*d*, spaced apart in the Y direction. One of the two side surfaces 215 is provided, facing the end surface 111 of one of the side wall portions 11. The other side surface 215 is provided, facing the end surface 111 of the other side wall portion 11.

As illustrated in FIGS. 1 to 5, the plurality of terminals 30 has the same shape. The plurality of terminals 30 is arranged in two rows in the X direction along the side wall portions 21*a* of the movable housing 20 and the side wall portions 11 of the fixed housing 10. The terminals 30 arranged in the rows in the X direction and the terminals 30 facing the arranged terminals 30 in the Y direction are placed in such a manner as to be symmetric with respect to the Y direction.

Figure 6:
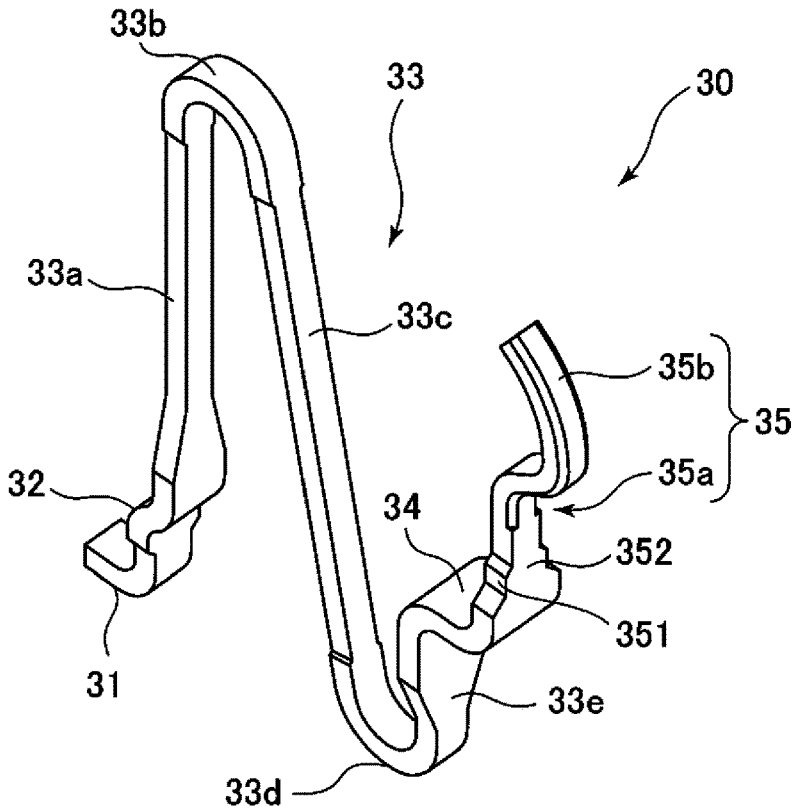
FIG. 6 is a perspective view of a terminal of the connector according to the embodiment of the present disclosure as viewed from above.
Figure 7:
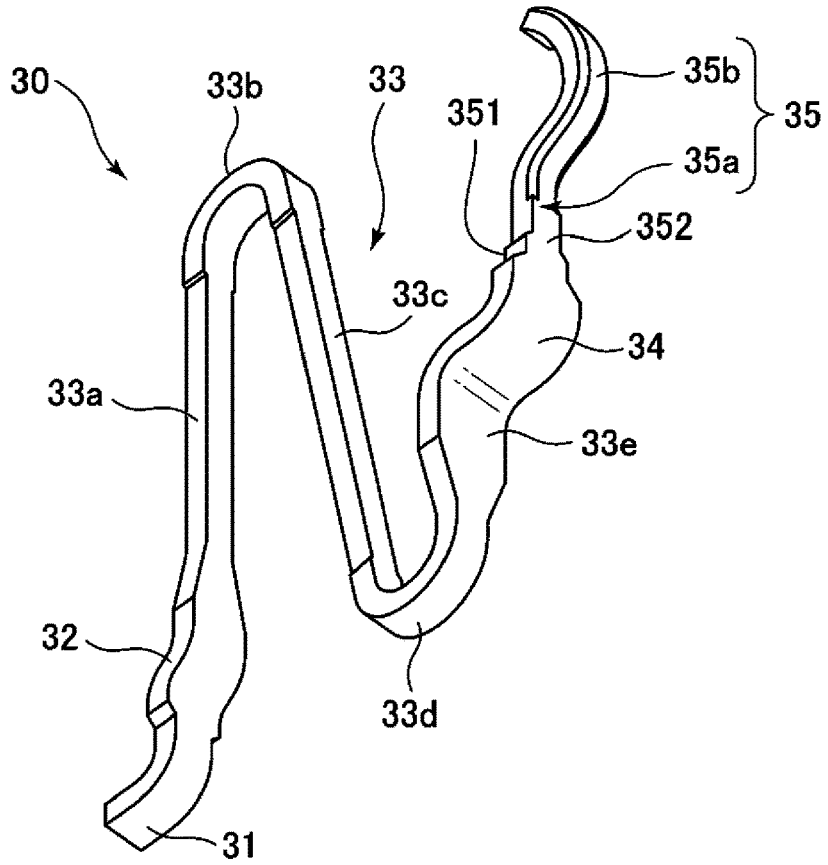
FIG. 7 is a perspective view of the terminal of the connector according to the embodiment of the present disclosure as viewed from below.
Figure 8:
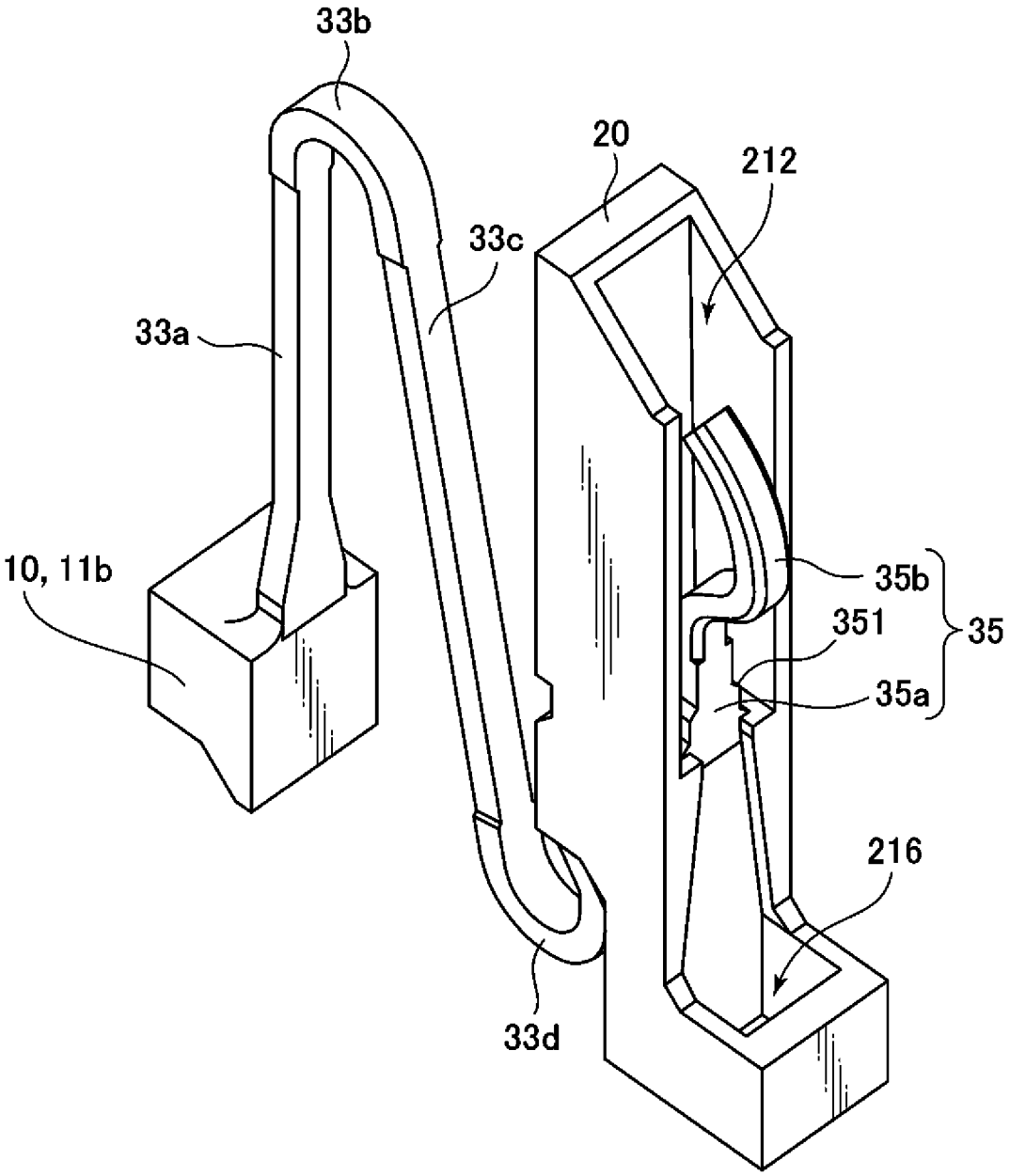
FIG. 8 is a perspective view of part of the connector according to the embodiment of the present disclosure in a Y direction.
Figure 9:
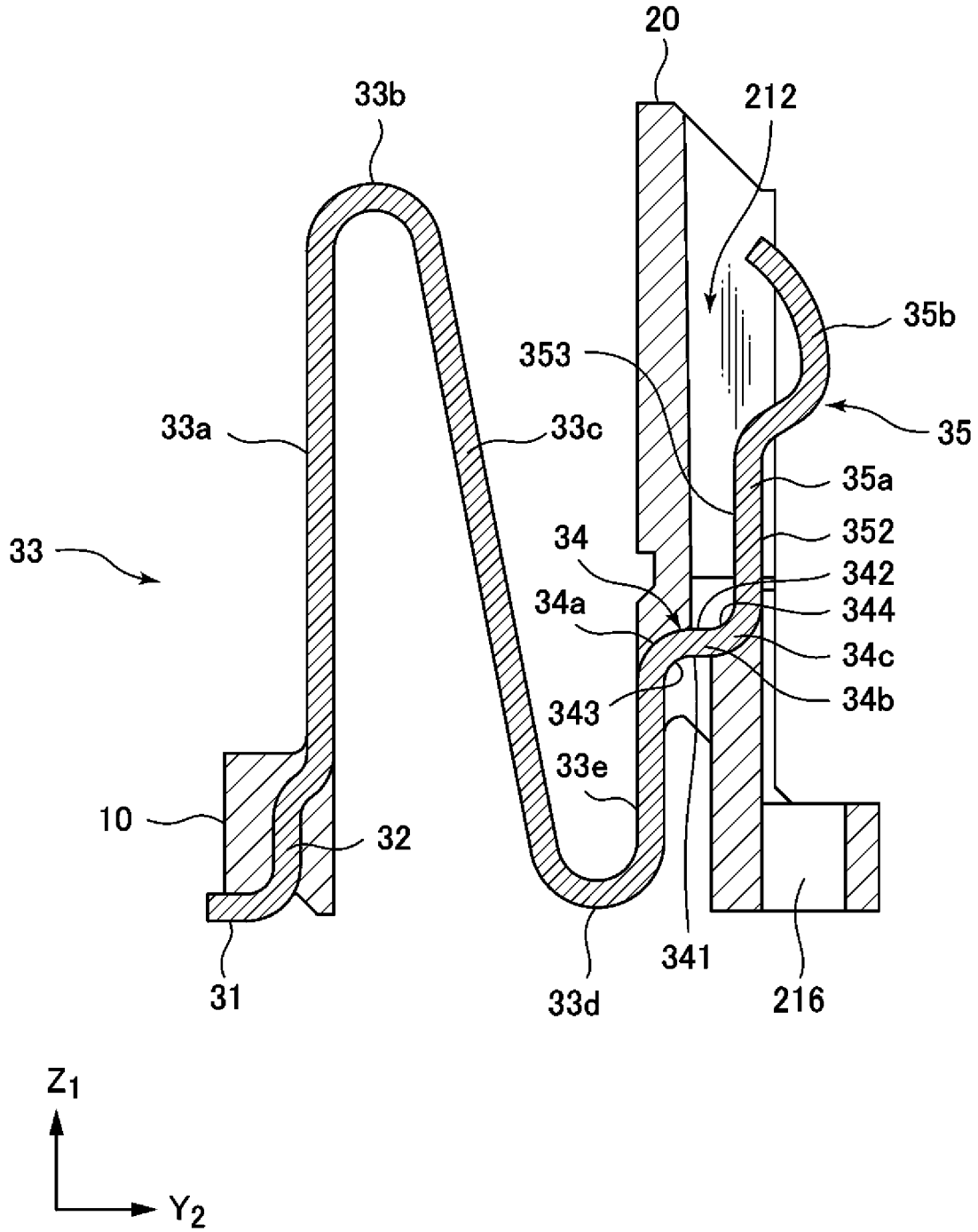
FIG. 9 is an enlarged cross-sectional view of part of section A-A illustrated in FIG. 2.

FIG. 6 is a perspective view of the terminal 30 of the connector according to the embodiment as viewed from above. FIG. 7 is a perspective view of the terminal 30 of the connector according to the embodiment as viewed from below. FIG. 8 is a perspective view of part of the connector according to the embodiment in the Y direction. FIG. 9 is an enlarged cross-sectional view of part of section A-A illustrated in FIG. 2.

The terminal 30 includes conductive material that can be bent, such as metal. Specifically, the terminal 30 includes the board connection portion 31, the first fixed portion 32, the elastic portion 33, the second fixed portion 34, and a contact portion 35 as illustrated in FIGS. 6 to 9.

The board connection portion 31 extends in the Y direction, and is exposed from the bottom portion of the fixed housing 10 (the holding portion 11*b*). The board connection portion 31 is a portion that is soldered to the circuit board 101. The first fixed portion 32 is buried by integral molding in the movable housing 20 (here, the holding portion 11*b*). In integral molding, the fixed housing 10 and the movable housing 20 are integrally molded, using the plurality of terminals 30 as inserts. The first fixed portion 32 is bent from the board connection portion 31 into a substantially S shape, and extends upwards (the Z1 direction).

The elastic portion 33 is provided between the first fixed portion 32 and the second fixed portion 34. The elastic portion 33 has elasticity that enables the movable housing 20 to be displaced relative to the fixed housing 10. Specifically, the elastic portion 33 includes a first straight portion 33*a* extending upward from the first fixed portion 32, a first folded portion 33*b* folded downward from the first straight portion 33*a*, a second straight portion 33*c* extending downward from the first folded portion 33*b*, a second folded portion 33*d* folded upward from the second straight portion 33*c*, and a third straight portion 33*e* that extends upward from the second folded portion 33*d* and is connected to the second fixed portion 34. The elastic portion 33 is configured in such a manner as to be connected from one end of the first fixed portion 32 to one end of the second fixed portion 34 in the order of the first straight portion 33*a*, the first folded portion 33*b*, the second straight portion 33*c*, the second folded portion 33*d*, and the third straight portion 33*e*. The second straight portion 33*c* is simply required to extend downward from the first folded portion 33*b* and be connected to the second folded portion 33*d*. In the embodiment, the second straight portion 33*c* extends downward and inward from the first folded portion 33*b*, and is connected to the second folded portion 33*d*. The elastic portion 33 is not held or supported by the fixed housing 10 and the movable housing 20, located in midair, and deforms elastically with the first fixed portion 32 and the second fixed portion 34 as fixed ends. The elastic portion 33 is formed in such a manner that a width thereof is less than the widths of the first fixed portion 32 and the second fixed portion 34. The elasticity of the elastic portion 33 can be adjusted according to the width of the elastic portion 33. The width here is the length of the terminal 30 in the X direction.

The second fixed portion 34 is buried by integral molding in the movable housing 20 (here, the side wall portion 21*a*). The second fixed portion 34 includes a first bent portion 34*a* bent inward from the third straight portion 33*e*, a fourth straight portion 34*b* extending inward from the first bent portion 34*a*, and a second bent portion 34*c* bent upward from the fourth straight portion 34*b*. In terms of the second fixed portion 34, at least any of a lower surface 341 of the fourth straight portion 34*b* or a lower surface 343 of the first bent portion 34*a*, and an upper surface 342 of the fourth straight portion 34*b* or an upper surface 344 of the second bent portion 34*c* is exposed from the movable housing 20 as illustrated in FIG. 9. In the embodiment, the lower surface 341 of the fourth straight portion 34*b*, the lower surface 343 of the first bent portion 34*a*, the upper surface 342 of the fourth straight portion 34*b*, and the upper surface 344 of the second bent portion 34*c* are exposed from the movable housing 20. The length of the second fixed portion 34 in the Y direction is greater than the maximum possible displacement caused by the elastic deformation of the contact portion 35 in the Y direction.

The contact portion 35 has elasticity and is provided at an end of the second fixed portion 34, and is exposed from the movable housing 20, or more specifically, the storage portion 212, in the mating recessed portion 21. A part of the contact portion 35 protrudes in such a manner as to form a curve toward the center of the mating recessed portion 21, and contacts the terminal 130 of the counterpart connector 100 mated with the movable housing 20, or more specifically, the mating recessed portion 21. The contact allows the contact portion 35 to deform elastically in the Y direction. As illustrated in FIG. 9, the contact portion 35 includes a fifth straight portion 35*a* extending upward from the second bent portion 34*c*, and the curved portion 35*b* that curves inward from the fifth straight portion 35*a*, and contacts the terminal 130 of the counterpart connector 100. As illustrated in FIGS. 6 to 9, a circumferential surface, which includes an inner surface 352 and an outer surface 353, of the fifth straight portion 35*a* is exposed from the movable housing 20, and the fifth straight portion 35*a* includes a stepped portion 351. The width of the stepped portion 351 is greater than the width of the curved portion 35*b* and less than the width of the second fixed portion 34. The stepped portion 351 is exposed from the movable housing 20 in the mating recessed portion 21. The curved portion 35*b* has a C shape, and curves in such a manner as to become increasingly closer to the curved portion 35*b* of the terminal 30 facing in the Y direction. A point that is closest to the curved portion 35*b* of the facing terminal 30, and a vicinity thereof can be used as a contact with the terminal 130 of the counterpart connector 100. The curved portion 35*b* curves outward in such a manner as to become increasingly distant from the point closest to the curved portion 35*b* of the facing terminal 30. In the embodiment, a distal end of the curved portion 35*b* is located below a distal end of the movable housing 20 in the Z1 direction, and is located at substantially the same height as, or below, the first folded portion 33*b*. The curved portion 35*b* and the distal end thereof are away from the movable housing 20 (the side wall portion 21*a*) under no load condition, that is, in a state where the counterpart connector 100 is not mated with the mating recessed portion 21. The contact portion 35 extends upward with the second fixed portion 34 as the fixed end and, accordingly, can be displaced in the X direction. Even if being displaced by the maximum displacement in the X direction, the contact portion 35 does not physically interfere with the movable housing 20 (the side wall portion 21*a*). The contact portion 35 is configured in such a manner as to deform easily and elastically by being formed in such a manner that a width thereof is less than the widths of the first fixed portion 32 and the second fixed portion 34.

[Connector Manufacturing Method]

The connector 1 of the embodiment can be produced by integral molding with a mold, using the plurality of terminals 30 as inserts. A method for manufacturing the connector 1 includes an insertion step, a molding step, and a releasing step. The insertion step includes the step of inserting the plurality of terminals 30 into the mold. The molding step includes the step of injecting resin into the mold in a state where at least parts of the second fixed portions 34 of the plurality of terminals 30 inserted in the mold are brought into contact with the mold and the plurality of terminals 30 is held in the mold and, accordingly, molding the fixed housing 10 and the movable housing 20. The releasing step includes the step of taking the connector 1 produced in the molding step out of the mold.

The insertion step includes the step of inserting the plurality of terminals 30 into the mold for molding the fixed housing 10 and the movable housing 20. The molding step of the embodiment includes the step of bringing a plurality of parts of the plurality of terminals 30 inserted in the mold into contact with the mold and, accordingly, fixing the plurality of terminals 30 in the mold. Specifically, the lower surfaces 341 and 343 and the upper surfaces 342 and 344 of the second fixed portions 34 are sandwiched between inner walls of the mold in the up-and-down direction, and the inner walls of the mold are brought into contact with the circumferences of the fifth straight portions 35*a*. Particularly the stepped portions 351 are sandwiched between the inner walls of the mold in the X direction. Consequently, the plurality of terminals 30 can be fixed firmly in the mold. In a state where the plurality of terminals 30 is fixed in this manner, resin is injected into the mold, and solidified. As a result, the fixed housing 10 and the movable housing 20 are molded.

The releasing step includes the step of releasing the connector 1 from the mold and taking the connector 1 out. The stepped portion 351 is sandwiched between the inner walls of the mold. As a result, a gap is provided between the inner walls of the mold and the contact portion 35. Hence, it is possible to prevent damage to the contact portion 35 caused by the mold and the contact portion 35 rubbing against each other upon releasing from the mold.

The connector 1 of the embodiment is a connector including the fixed housing 10, the movable housing 20 that is placed in the fixed housing 10, can be displaced relative to the fixed housing 10, and mates with the counterpart connector 100, and the plurality of terminals 30 that is held by the fixed housing 10 and the movable housing 20, and contacts the terminals 130 of the counterpart connector 100. The terminal 30 of the connector 1 includes the first fixed portion 32 buried by integral molding in the fixed housing 10, the second fixed portion 34 buried by integral molding in the movable housing 20, the elastic portion 33 that is provided between the first fixed portion 32 and the second fixed portion 34, and has elasticity that enables the movable housing 20 to be displaced relative to the fixed housing 10, and the contact portion 35 that has elasticity, is provided at the end of the second fixed portion 34, and contacts the terminal 130 of the counterpart connector 100 mated with the movable housing 20.

Consequently, it is possible to promote a reduction in the size of and an increase in the productivity of the product. Generally, a connector such as a floating connector is configured by producing a fixed housing and a movable housing separately and assembling them by a method such as press fit. Accordingly, if the press-fit direction is, for example, the height direction, the size in the height direction may vary depending on the press fit condition. As a result, there may be variations in product size. Hence, a design with a sufficient space allowance in the height direction is required, which results in an increase in product size. On the contrary, in the embodiment, it is configured in such a manner that the first fixed portion 32 is buried in the fixed housing 10, and the second fixed portion 34 in the movable housing 20 by integral molding. Accordingly, the positional relationships of the fixed housing 10, the terminal 30, and the movable housing 20 can be made uniform. Hence, a design where variations due to the press fit condition are considered is not required. As a result, the product can be reduced in size. Moreover, in the embodiment, it is configured in such a manner that the first fixed portion 32 is buried in the fixed housing 10, and the second fixed portion 34 in the movable housing 20 by integral molding. Hence, it is possible to reduce the number of manufacturing man-hours as compared to a connector created by producing the fixed housing 10 and the movable housing 20 separately and then assembling them by, for example, press fit, and to increase productivity.

In the embodiment, the elastic portion 33 includes the first straight portion 33*a* extending upward from the first fixed portion 32, the first folded portion 33*b* folded downward from the first straight portion 33*a*, the second straight portion 33*c* extending downward from the first folded portion 33*b*, the second folded portion 33*d* folded upward from the second straight portion 33*c*, and the third straight portion 33*e* that extends upward from the second folded portion 33*d* and is connected to the second fixed portion 34. The second fixed portion 34 includes the first bent portion 34*a* bent inward from the third straight portion 33*e*, the fourth straight portion 34*b* extending inward from the first bent portion 34*a*, and the second bent portion 34*c* bent upward from the fourth straight portion 34*b*. The contact portion 35 includes the fifth straight portion 35*a* extending upward from the second bent portion 34*c*, and the curved portion 35*b* that curves inward from the fifth straight portion 35*a*, and contacts the terminal 130 of the counterpart connector 100. At least any of the lower surface of the fourth straight portion 34*b* or the first bent portion 34*a* and the upper surface of the fourth straight portion 34*b* or the second bent portion 34*c* of the second fixed portion 34 is exposed from the movable housing 20.

Consequently, at least any of the lower surface of the fourth straight portion 34*b* or the first bent portion 34*a* and the upper surface of the fourth straight portion 34*b* or the second bent portion 34*c* can be brought into contact with the mold upon integral molding. Hence, the terminal can be fixed in the mold.

In the embodiment, the elastic portion 33 and the contact portion 35 are formed in such a manner that the widths thereof are less than the widths of the first fixed portion 32 and the second fixed portion 34.

Consequently, it becomes easy to deform the elastic portion 33 and the contact portion 35. Accordingly, it is possible to increase the elasticity of the elastic portion 33 and the contact portion 35. In other words, the easy deformation of the elastic portion 33 can facilitate the displacement of the movable housing 20 relative to the fixed housing 10. The easy deformation of the contact portion 35 can facilitate contact with the terminal of the counterpart connector 100.

In the embodiment, the fifth straight portion 35*a* includes the stepped portion 351 of which width is greater than the width of the curved portion 35*b* and is less than the width of the second fixed portion 34, and the stepped portion 351 is exposed from the movable housing 20.

Consequently, even if the mold comes into contact with the stepped portion 351 during integral molding, since the width of the stepped portion 351 is greater than the width of the curved portion 35*b*, it is possible to maintain the mold and the curved portion 35*b* apart and prevent contact between the mold and the curved portion 35*b*. Hence, it is possible to prevent the rubbing of the mold and the contact portion 35 against each other, which may be caused when the terminal is held by the mold during integral molding, or when the connector is released from the mold after integral molding. Moreover, it is possible to prevent the deformation of the contact portion 35 caused by the contact of the mold with the terminal when the mold and the terminal are set in integral molding.

Moreover, it is possible to employ a manufacturing method by insert molding where the stepped portion 351 is brought into contact with the mold to fix the terminal 30 in the mold.

In the embodiment, the movable housing 20 includes the mating recessed portion 21 that mates with the counterpart connector 100. In the mating recessed portion 21, the contact portion 35 is exposed from the movable housing 20. The curved portion 35*b* curves inward from the fifth straight portion 35*a*. The movable housing 20 includes the holes 216 that cause the inside of the mating recessed portion 21 to communicate with the outside of the movable housing 20, at the positions below the curved portions 35*b* in the mating recessed portion 21. Consequently, it is possible to employ a manufacturing method by insert molding where the terminals 30 are pressed from below by the mold and fixed in the mold.

In the embodiment, the inner surface 352 or the outer surface 353 of the fifth straight portion 35*a* is exposed from the movable housing 20. Consequently, it is possible to employ a manufacturing method by insert molding where the surface, on the side where the curved portion 35*b* curves, of the fifth straight portion 35*a* is brought into contact with the mold during integral molding to fix the terminal 30 in the mold. Moreover, if the inner surface 352 and the outer surface 353 are exposed from the movable housing 20, it is possible to employ a manufacturing method by insert molding where the mold is brought into contact with the inner surface 352 and the outer surface 353 to fix the terminal 30 in the mold.

The present disclosure is not limited to the above embodiment and also includes other embodiments illustrated below. Moreover, the present disclosure also includes a mode including all of the above embodiment and the following other embodiments and a mode of any combination of them. Furthermore, various omissions, replacements, and changes can be performed on these embodiments within the scope that does not depart from the scope of the disclosure, and the modifications are also included in the present disclosure.

In the above embodiment, it is configured in such a manner that the lower surface 341 of the fourth straight portion 34*b*, the lower surface 343 of the first bent portion 34*a*, the upper surface 342 of the fourth straight portion 34*b*, and the upper surface 344 of the second bent portion 34*c* are exposed from the movable housing 20. However, the present disclosure is not limited to this configuration. It is simply required to expose at least any one of the surfaces, the lower surface 341 of the fourth straight portion 34*b*, the lower surface 343 of the first bent portion 34*a*, the upper surface 342 of the fourth straight portion 34*b*, and the upper surface 344 of the second bent portion 34*c*, from the movable housing 20. For example, the lower surface 341 of the fourth straight portion 34*b* or the lower surface 343 of the first bent portion 34*a*, and the upper surface 342 of the fourth straight portion 34*b* or the upper surface 344 of the second bent portion 34*c* may be exposed. Alternatively, for example, the lower surface 341 of the fourth straight portion 34*b* and the stepped portion 351 may be sandwiched from above by the mold and below, and exposed.

In the above embodiment, it is configured in such a manner that the second fixed portion 34 of the terminal 30 includes the fourth straight portion 34*b*. However, the present disclosure is not limited to this configuration. The terminal 30 may not include the fourth straight portion 34*b*. In that case, the first bent portion 34*a* and the second bent portion 34*c* may be directly connected together, and the second fixed portion 34 may be formed into an S shape. At this point, the lower surface 343 of the first bent portion 34*a* and/or the upper surface 344 of the second bent portion 34*c* may be exposed from the movable housing 20.

Figure 10:
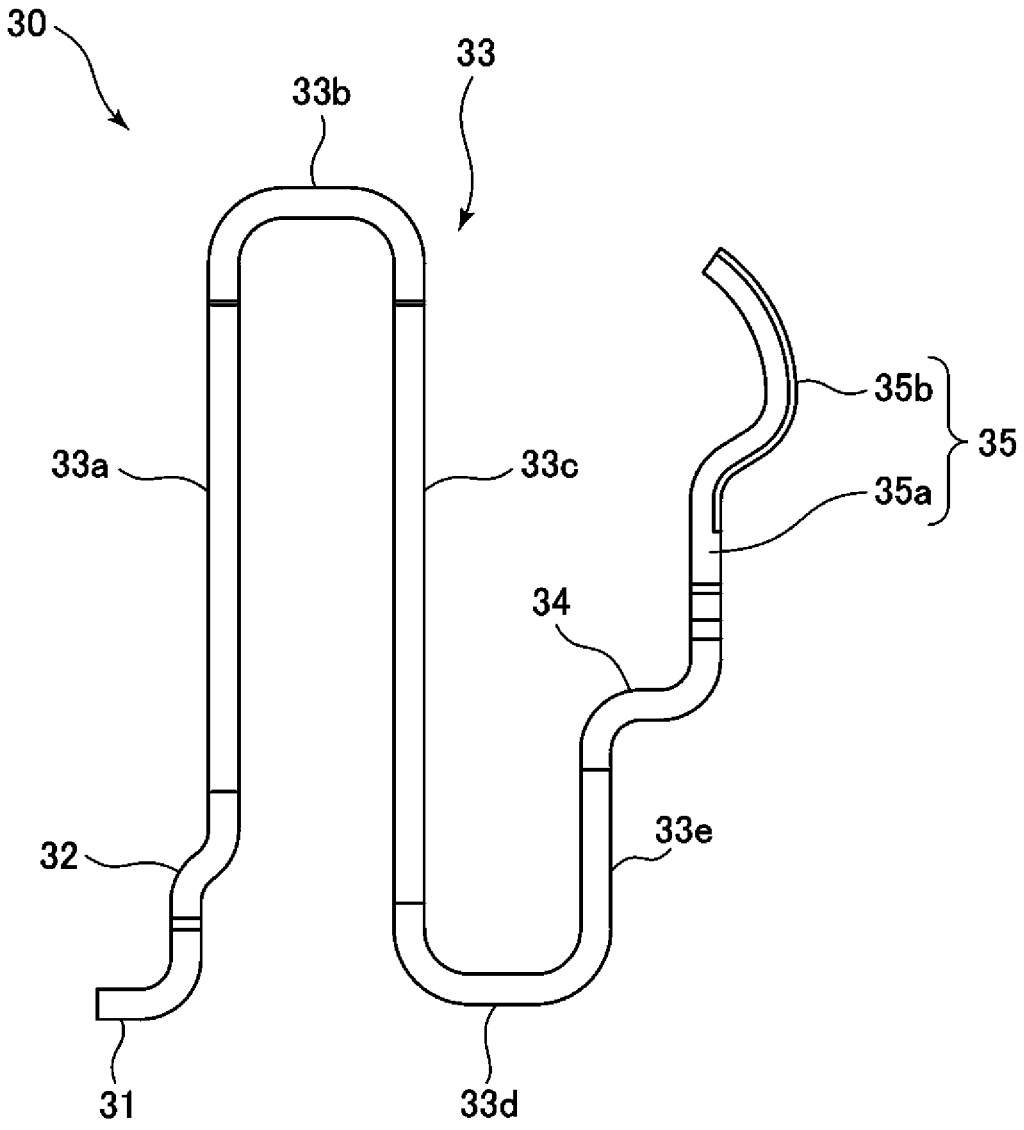
FIG. 10 is a side view of a terminal according to a modification of the connector of the embodiment of the present disclosure.
Figure 11:
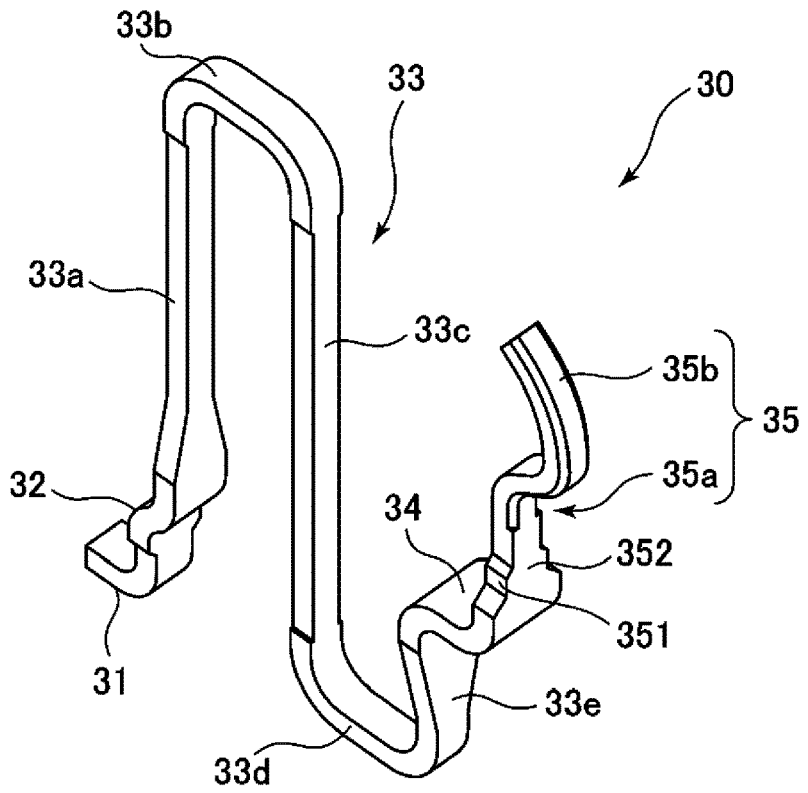
FIG. 11 is a perspective view of the terminal according to the modification of the connector of the embodiment of the present disclosure as viewed from above.
Figure 12:
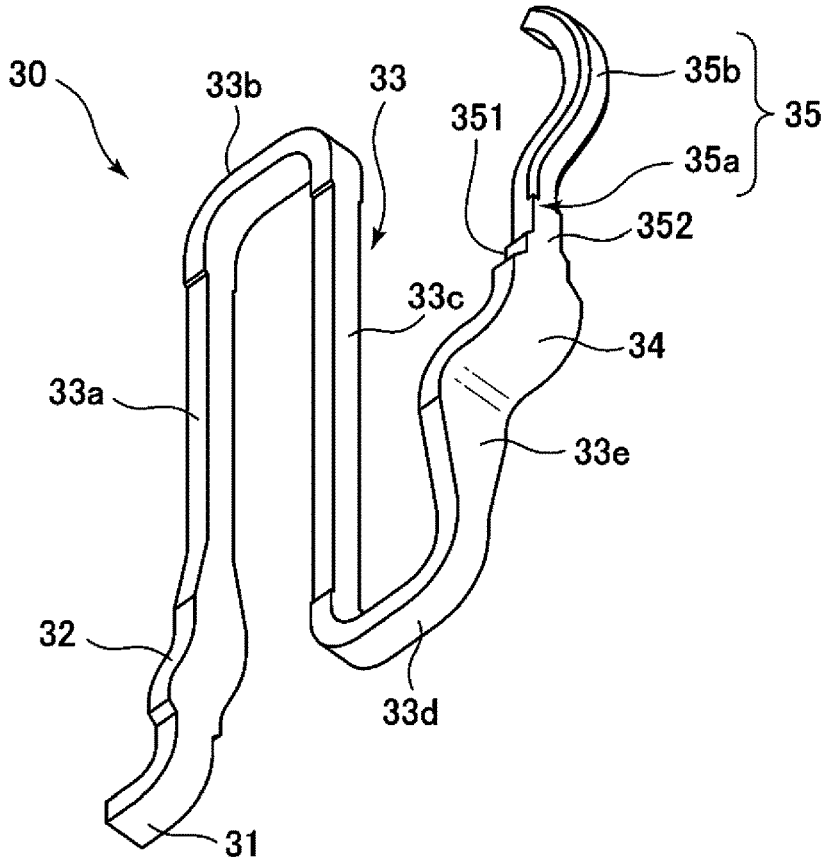
FIG. 12 is a perspective view of the terminal according to the modification of the connector of the embodiment of the present disclosure as viewed from below.

A terminal 30 according to a modification of the connector of the above embodiment is described, using FIGS. 10 to 12. The basic configuration of the terminal 30 according to the modification is the same as the terminal 30 of the above embodiment. Accordingly, descriptions of the same features of the terminal 30 of the above embodiment are omitted, and different features are described.

FIG. 10 is a side view of the terminal according to the modification of the connector of the embodiment. FIG. 11 is a perspective view of the terminal according to the modification of the connector of the embodiment as viewed from above. FIG. 12 is a perspective view of the terminal according to the modification of the connector of the embodiment as viewed from below. As illustrated in FIGS. 10 to 12, the terminal 30 according to the modification is different from the terminal 30 of the above embodiment in that the first folded portion 33*b* and the second folded portion 33*d* have a U shape and that the second straight portion 33*c* extends only downward. In other words, the first folded portion 33*b* of the terminal 30 of the above embodiment has a C shape that protrudes upward, and the second folded portion 33*d* has a C shape that protrudes downward whereas the first folded portion 33*b* of the terminal 30 of the modification has a U shape that protrudes upward and the second folded portion 33*d* has a U shape that protrudes downward. With changes in the shapes of the first folded portion 33*b* and the second folded portion 33*d*, the second straight portion 33*c* of the terminal 30 according to the modification extends (directly) downward from the first folded portion 33*b* and is connected to the second folded portion 33*d*. The terminal 30 used for the connector 1 of the present disclosure can include not only the terminal 30 of the embodiment but also the terminal 30 of the modification. Also if the terminal 30 used for the connector 1 of the present disclosure is the terminal 30 of the modification, the elastic portion 33 can deform elastically in the Y direction.

Figure 13:
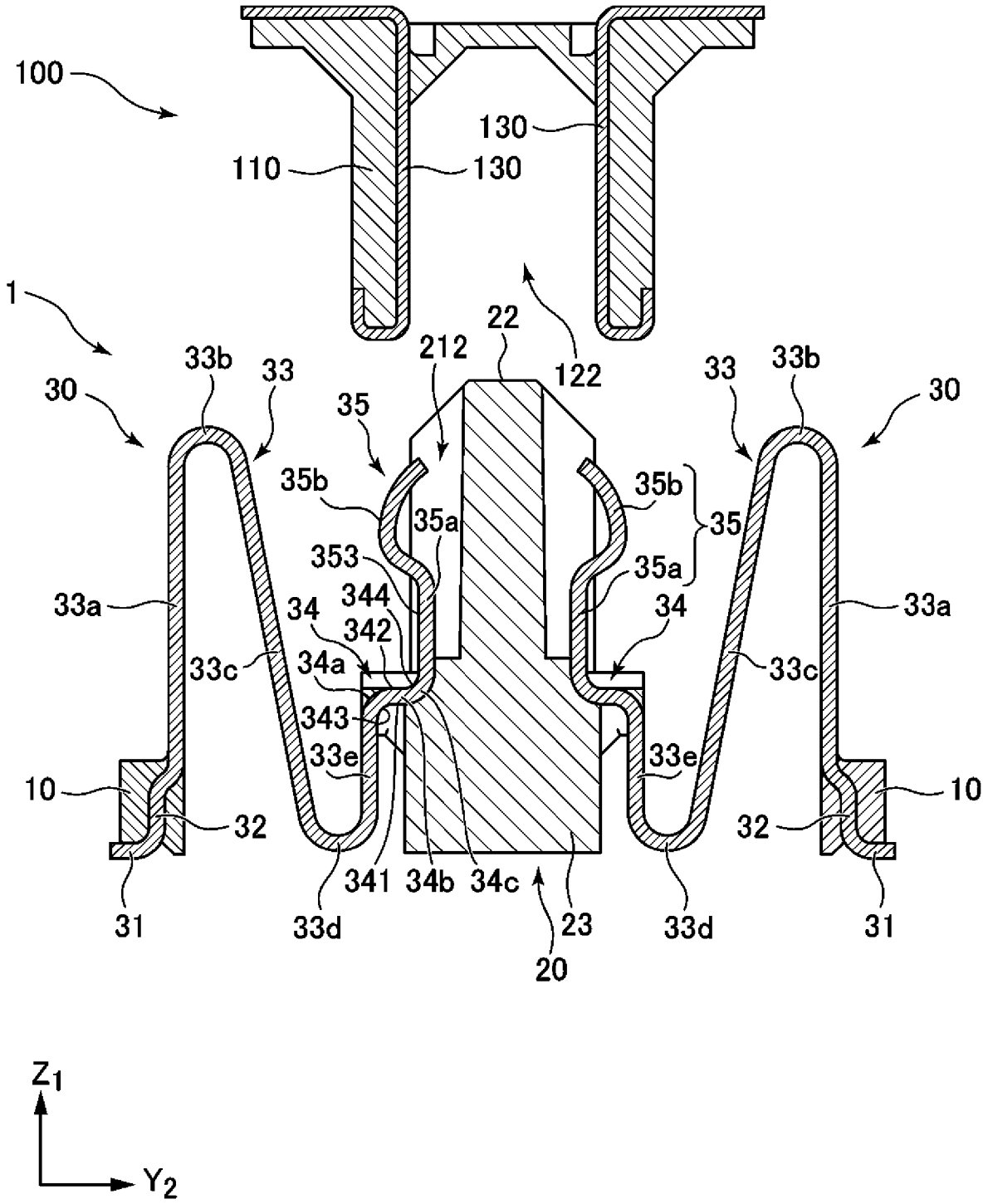
FIG. 13 is a cross-sectional view of a connector and a counterpart connector according to another embodiment of the present disclosure.
Figure 14:
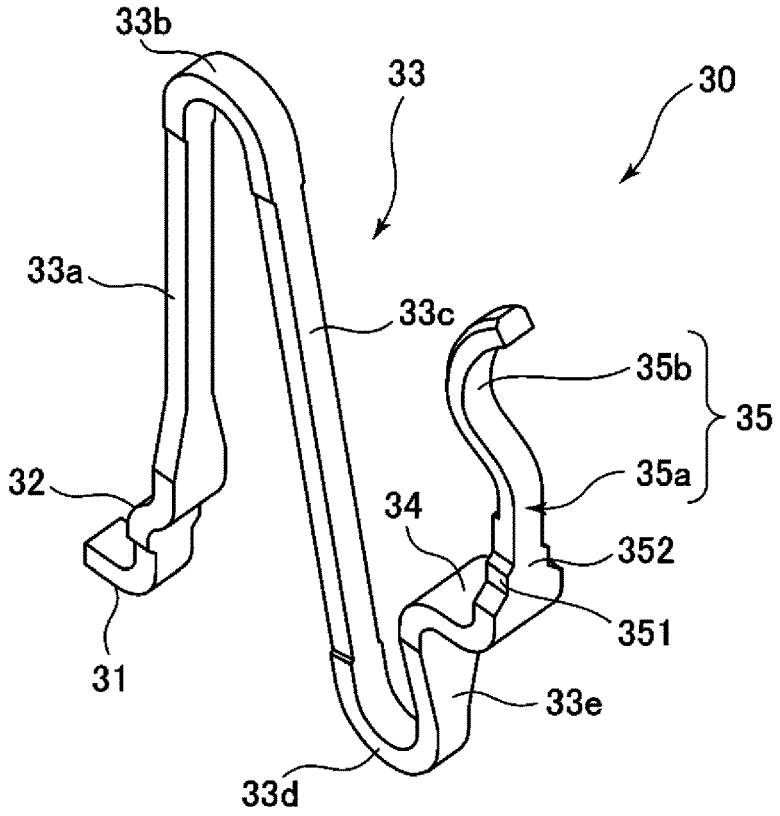
FIG. 14 is a perspective view of a terminal of the connector according to the other embodiment of the present disclosure as viewed from above.
Figure 15:
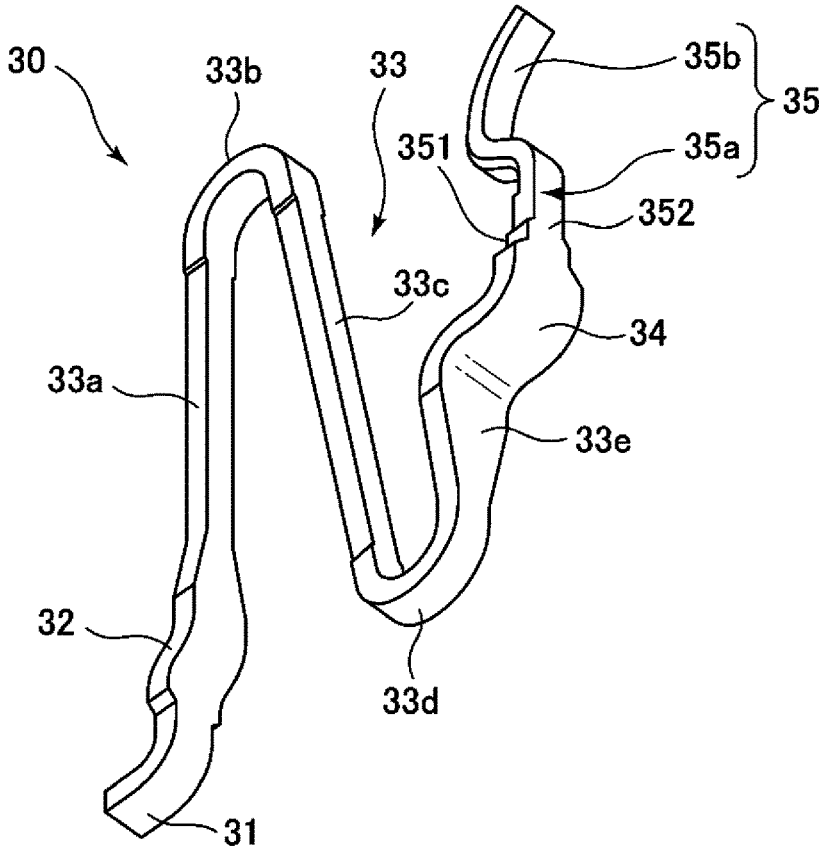
FIG. 15 is a perspective view of the terminal of the connector according to the other embodiment of the present disclosure as viewed from below.

A connector 1 and a counterpart connector 100 according to another embodiment of the present disclosure are described, using FIGS. 13 to 15. The basic configurations of the connector 1 and the counterpart connector 100 according to the other embodiment are similar to those of the above embodiment. Accordingly, descriptions of the same features as the embodiment are omitted. Different features are described.

FIG. 13 is a cross-sectional view of the connector and the counterpart connector according to the other embodiment of the present disclosure. FIG. 14 is a perspective view of a terminal of the connector according to the other embodiment of the present disclosure as viewed from above. FIG. 15 is a perspective view of the terminal of the connector according to the other embodiment of the present disclosure as viewed from below. As illustrated in FIG. 13, the mating relationship between the connector 1 and the counterpart connector 100 may be opposite to the above embodiment. In other words, the counterpart connector 100 fits into the mating recessed portion 21 of the movable housing 20 to mate the connector 1 (the movable housing 20) and the counterpart connector 100 in the above embodiment. On the other hand, it may be configured in such a manner that a mating protruding portion 22 of the movable housing 20 fits into a mating recessed portion 122 of the counterpart connector 100 to mate the connector 1 (the movable housing 20) and the counterpart connector 100 as illustrated in FIG. 13.

Specifically, as illustrated in FIG. 13, the housing 110 of the counterpart connector 100 is provided with the mating recessed portion 122 into which the mating protruding portion 22 of the movable housing 20 fits. The terminal 130 of the counterpart connector 100 is provided along an inner surface and an outer edge of the mating recessed portion 122 in such a manner as to be exposed to the inside and outside of the mating recessed portion 122. The movable housing 20 is formed by integral molding in such a manner as to include a base 23 that holds the second fixed portion 34 and the mating protruding portion 22 extending upward form the base 23. In FIG. 13, the upper surface 342 of the fourth straight portion 34*b*, the upper surface 344 of the second bent portion 34*c*, the lower surface 341 of the fourth straight portion 34*b*, and the lower surface 343 of the first bent portion 34*a* of the second fixed portion 34 are exposed from the movable housing 20. However, it is simply required to expose, from the movable housing 20, at least any one of the upper surface 342 of the fourth straight portion 34*b*, the upper surface 344 of the second bent portion 34*c*, the lower surface 341 of the fourth straight portion 34*b*, and the lower surface 343 of the first bent portion 34*a*. The storage portion 212 is provided, recessed in a side surface of the mating protruding portion 22, and does not interfere with the contact portion 35 even if the contact portion 35 deforms elastically in the Y direction. The contact portion 35 is stored in the storage portion 212, and exposed from the movable housing 20. In the above embodiment, the curved portion 35*b* curves inward from the fifth straight portion 35*a*. On the other hand, in the other embodiment, the curved portion 35*b* curves outward from the fifth straight portion 35*a* as illustrated in FIGS. 13 to 15. In other words, the curved portion 35*b* partially protrudes toward the outside of the mating protruding portion 22 in such a manner as to form a curve and contacts the terminal 130 of the counterpart connector 100 mated with the mating protruding portion 22. This contact allows the contact portion 35 to deform elastically in the Y direction.

In the above embodiment, the stepped portion 351 is provided. However, an embodiment without the stepped portion 351 is also included in the scope of the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector comprising:

a fixed housing;

a movable housing in the fixed housing, the movable housing being configured to be displaceable relative to the fixed housing and mate with a counterpart connector; and a plurality of first terminals and a plurality of second terminals held by the fixed housing and the movable housing, the plurality of first and second terminals being configured to contact terminals of the counterpart connector, wherein each of the plurality of first and second terminals includes:

a first fixed portion buried by integral molding in the fixed housing;

a second fixed portion buried by the integral molding in the movable housing;

an elastic portion between the first fixed portion and the second fixed portion, the elastic portion having elasticity that allows the movable housing to be displaced relative to the fixed housing; and a contact portion at an end of the second fixed portion, the contact portion having elasticity and being configured to contact the terminal of the counterpart connector mated with the movable housing, the plurality of first terminals has a same shape as the plurality of second terminals, the plurality of first terminals and the plurality of second terminals are arranged in a first direction, respectively, and the plurality of first terminals faces the plurality of second terminals in a second direction perpendicular to the first direction in such a manner that the shape of the plurality of first terminals is symmetric with the shape of the plurality of second terminals with respect to the second direction, the movable housing comprises a mating recessed portion in a top portion of the movable housing, the contact portion of each of the plurality of first and second terminals is provided in the mating recessed portion of the movable housing, and the terminals of the counterpart connector are inserted into the mating recessed portion of the movable housing from a top to a bottom of the movable housing.

2. The connector according to claim 1, wherein the elastic portion includes:

a first straight portion extending upward from the first fixed portion;

a first folded portion folded downward from the first straight portion;

a second straight portion extending downward from the first folded portion;

a second folded portion folded upward from the second straight portion; and a third straight portion extending upward from the second folded portion and connected to the second fixed portion, the second fixed portion includes:

a first bent portion bent inward from the third straight portion;

a fourth straight portion extending inward from the first bent portion; and a second bent portion bent upward from the fourth straight portion, the contact portion includes:

a fifth straight portion extending upward from the second bent portion; and a curved portion curving inward or outward from the fifth straight portion, the curved portion being configured to contact the terminal of the counterpart connector, and at least one of a lower surface of the fourth straight portion or the first bent portion, or an upper surface of the fourth straight portion or the second bent portion is exposed from the movable housing.

3. The connector according to claim 2, wherein the elastic portion has a width less than the first fixed portion and the second fixed portion, and the contact portion has a width less than the first fixed portion and the second fixed portion.

4. The connector according to claim 2, wherein the fifth straight portion includes a stepped portion, and the stepped portion has a width greater than the curved portion and less than the second fixed portion, and is exposed from the movable housing.

5. The connector according to claim 2, wherein the movable housing includes a mating recessed portion that mates with the counterpart connector, the contact portion is exposed from the movable housing in the mating recessed portion, the curved portion curves inward from the fifth straight portion, and the connector further comprises a hole causing the inside of the mating recessed portion to communicate with the outside of the movable housing, at a position below the curved portion in the mating recessed portion.

6. The connector according to claim 2, wherein an inner or outer surface of the fifth straight portion is exposed from the movable housing.

7. A method for manufacturing the connector according to claim 1, comprising a molding step of molding the fixed housing and the movable housing, wherein the molding step includes:

bringing at least a part of the second fixed portion of the terminal of the connector inserted into a mold into contact with the mold and holding the terminal of the connector in the mold, and injecting resin into the mold.

8. A connector comprising:

a fixed housing;

a movable housing in the fixed housing, the movable housing being configured to be displaceable relative to the fixed housing and mate with a counterpart connector; and a plurality of first terminals and a plurality of second terminals held by the fixed housing and the movable housing, the plurality of first and second terminals being configured to contact terminals of the counterpart connector, wherein each of the plurality of first and second terminals includes:

a first fixed portion buried by integral molding in the fixed housing;

a second fixed portion buried by the integral molding in the movable housing;

an elastic portion between the first fixed portion and the second fixed portion, the elastic portion having elasticity that allows the movable housing to be displaced relative to the fixed housing; and a contact portion at an end of the second fixed portion, the contact portion having elasticity and being configured to contact the terminal of the counterpart connector mated with the movable housing, the plurality of first terminals has a same shape as the plurality of second terminals, the plurality of first terminals and the plurality of second terminals are arranged in a first direction, respectively, and the plurality of first terminals faces and the plurality of second terminals in a second direction perpendicular to the first direction in such a manner that the shape of the plurality of first terminals is symmetric with the shape of the plurality of second terminals with respect to the second direction, the movable housing comprises a mating opening at a top portion of the movable housing between the contact portions, and the terminals of the counterpart connector are inserted into the movable housing through the opening at the top portion of the movable housing from a top to a bottom of the movable housing.

* * * * *